United States Patent [19]

Lindenmaier

[11] 4,067,299

[45] Jan. 10, 1978

[54] SPLIT-GAS PRODUCTION FOR INTERNAL COMBUSTION ENGINE

[75] Inventor: Klaus Lindenmaier, Stuttgart, Germany

[73] Assignee: Daimler-Benz Aktiengesellschaft, Germany

[21] Appl. No.: 724,347

[22] Filed: Sept. 17, 1976

[30] Foreign Application Priority Data

Sept. 25, 1975 Germany ..... 2542681

[51] Int. Cl.[2] ..... F02B 43/08; F23N 1/00; C10J 3/00

[52] U.S. Cl. ..... 123/3; 123/1 A; 23/230 A; 48/107; 252/373; 431/12; 431/37

[58] Field of Search ..... 123/1 A, 3, 32 ST, 119 E, 123/122 G; 23/230 A, 253 A, 281; 48/85, 107; 252/373; 431/12, 37, 38, 90

[56] References Cited

U.S. PATENT DOCUMENTS

| | | | |
|---|---|---|---|
| 3,817,229 | 6/1974 | Stumpp | 123/97 B |
| 3,914,091 | 10/1975 | Yamagishi | 431/12 |
| 3,919,113 | 11/1975 | Reynolds | 252/373 |
| 3,947,217 | 3/1976 | Graat | 431/12 |
| 4,002,153 | 1/1977 | Moriya | 123/32 ST |

FOREIGN PATENT DOCUMENTS

| | | | |
|---|---|---|---|
| 2,134,957 | 2/1973 | Germany | 431/90 |
| 1,441,039 | 6/1976 | United Kingdom | 123/3 |

*Primary Examiner*—Charles J. Myhre
*Assistant Examiner*—William Randolph
*Attorney, Agent, or Firm*—Craig & Antonelli

[57] ABSTRACT

A method and apparatus for continuously producing a charge gas mixture for the operation of an internal combustion engine in which liquid hydrocarbons are partially oxidized into a combustible gas mixture within a reactor under insufficiency of air, whereby the liquid hydrocarbons are admixed at a predetermined ratio below the stoichiometric ratio to a first partial air quantity flow which is preheated prior to entry into the reactor, in which additionally the hot gas mixture formed in the reactor is cooled off while giving off at least a considerable part of its heat to the first partial air quantity flow, is mixed with a second partial air quantity flow at least at a stoichiometric approximately constant mixture ratio and is fed to the internal combustion engine; the second partial air quantity flow itself or a quantity flow containing the second partial air quantity flow as a predominant component is continuously measured as regards quantity and the supply of the liquid hydrocarbons is metered as a function of the measurement of the magnitude of this quantity flow while the quantity flow of the gas mixture formed by the reactor is throttled in relatively hot condition.

33 Claims, 2 Drawing Figures

SPLIT-GAS PRODUCTION FOR INTERNAL COMBUSTION ENGINE

The present invention relates to a method for continuously producing a charge-gas mixture for the operation of an internal combustion engine, in which liquid hydrocarbons are partially oxidized into a combustible gas mixture within a gas generator under lack of air or insufficiency of air, whereby the liquid hydrocarbons are admixed to a first partial air quantity flow which is preheated prior to the entry into the gas generator at a predetermined ratio below the stoichiometric ratio, and in which additionally the hot gas mixture formed in the gas generator is cooled off while giving off at least a considerable part of its heat to the first partial air quantity flow, is mixed with a second partial air quantity flow at an at least stoichiometrically approximately constant mixture ratio and is fed to the internal combustion engine.

The method so far described is far-reachingly disclosed in the German Offenlegungsschrift No. 2,108,579. On the other hand, the measure to supply the heat required for the necessary preheating by means of a recuperator which is fed by the hot gas mixture produced in the gas generator is based on internal developments in the facilities of the assignee of this application.

The following is to be said as background of the present invention: It is known that during the operation of Otto-engines with gas, especially with the use of gases rich in methane, carbon monoxide and hydrocarbons, not only very favorable harmful material emission values but also considerably higher efficiencies are attainable than with the operation by means of liquid hydrocarbons. However, it is disadvantageous in that connection that the storage of such permanent gases in the vehicle is very problematical.

With the use of processes known from the gas-producing industry, the production of gas mixtures rich in methane, carbon monoxide and hydrogen from liquid hydrocarbons aboard motor vehicles is possible for the operation of Otto-engines so that the advantages of gas-operated Otto-engines and the advantages of the storage of liquid fuel can be combined.

Of the different processes possible for the gas production, the so-called air-splitting process is particularly suited. For that purpose, liquid fuel is converted into a gas only by air admixture, and more particularly in a quantity below the stoichiometric quantity by partial oxidation. The engine to be fed can take over by its suction effect the feed of the gases through the gas generator.

The composition of the split gas mixture which will be obtained with the thermal splitting, for example, of methanol under air admixtures at temperatures of above 800° C. will change in dependence on the air ratio in the splitting reactor, however, the corresponding split gas mixture is suitable over a wide range for engine operations.

The thermal splitting of the liquid hydrocarbons takes place—depending on the completeness of the oxidation, i.e., depending on the magnitude of the air/fuel ratio—either endothermically or exothermically. In case of methanol, for example, the auto-thermic point—the manner of processing at which neither heat is produced nor heat is removed from the environment—lies at a fuel/air ratio of 0.18. At the auto-thermic point, the heating value of the fed-in mixture is equal to the combustion heat of the resulting split gases. With a decreasing air ratio number—in relation to the auto-thermic point—or with an increasing fuel quantity, the split gas temperature drops compared to the mixture inlet temperature. With an increasing air ratio number or with a decreasing fuel quantity, it increases. On the other hand, with a decreasing air ratio number—in relation to the auto-thermic point—analogous to an increasing fuel quantity, the heating value of the split gas mixture increases whereas it decreases with an increasing air ratio number. The noticeable heat of the resulting split gas and its temperature is therefore analogous in the same sense to the air ratio number or oppositely analogous to the added fuel quantity.

Since the reaction takes place at high temperatures (greater than 800° C.), the split gas is produced also at high temperatures; the noticeable heat represents therefore already a considerable proportion of the heating value of the input mixture which cannot be used in the engine and which additionally leads to an undesirable increase of the suction mixture temperature of the engine. For purposes of improving the heat balance of such a system, it is therefore meaningful to transfer at least a part of the noticeable heat of the split gas in a heat-exchanger onto the input mixture.

The process mentioned hereinabove results from these considerations which process could be realized approximately in the following manner: the gas generator is located in a by-pass parallel to a fixed throttle place arranged in the suction pipe of the engine which gas generator essentially consists of a heat-exchanger and of a reactor. A part of the air fed by the engine flows after the admixture of liquid fuel, while heating up, through one side of the heat-exchanger into the reactor where the conversion into a gas mixture takes place by partial oxidation. The hot gas leaves the reactor by way of the other side of the heat-exchanger, while cooling off, and is mixed with the suction air of the engine in the suction pipe. The gas-air mixture reaches the engine after passing a throttle valve serving for the engine control.

The advantages of the heat-exchanger reside in that the mixture sucked in by the engine is cooler and in that the heat contained in the split gas can be utilized usefully for the preheating of the input mixture which is necessary anyhow for a reaction progress. However, a feedback effect results from the installation of the heat-exchanger, whereby changes in the gas generator output temperature are transmitted to the input side and influence correspondingly the reaction temperature. The generator output temperature may increase, for example, due to a slight erroneous metering of the fuel quantity, as a result of which the air ratio number changes. Such small changes in the air ratio number of the split gas lead, by reason of the feedback effect, to very large changes in the split gas temperature. For example, an increase of the air ratio number effects at first an increase of the split gas temperature which entails by way of the heat-exchanger an increase of the temperature of the input mixture which again has as a consequence a further increase of the split gas temperature. With a methanol split gas generator which operates with an operating temperature of 800° C. and an air ratio number of 0.25, a change of the air ratio number by only 0.05 in this example has as a consequence a temperature change of 400° C. This either leads to an extinction of the splitting reaction or to a thermal overloading of the reactor and heat-exchanger material.

The system is therefore unstable to the highest degree from a control point of view and has to be completed by a control system which stabilizes the split gas temperature, for example, by the control of the air ratio number of the splitting reaction. It would be feasible to realize the same by measuring the split gas temperature and by taking a corresponding influence on the air/fuel ratio at the reactor input. This possibility, however, makes necessary a large number of individual elements, electronic parts and electro-hydraulic parts all prone to failures. A failure of only a single part may destroy the entire split gas producer.

It is the aim of the present invention to indicate a possibility how a stabilization of the split gas production can be achieved by means of simple structural parts compatible with the system.

As solution to the underlying problems, one proceeds according to the present invention with the type of process described hereinabove in such a manner that a quantity flow containing the second partial air quantity flow as predominant component or—especially—the second partial air quantity flow itself is continuously measured as regards quantity and the feed of the liquid hydrocarbons is metered according to the indication of the magnitude of this quantity flow of the gas mixture formed by the gas generator is throttled in as hot as possible a condition.

In that connection—in contrast to the customary processes—not the air quantity fed to the reactor is utilized for the controlled admixture of the fuel but instead the air quantity directly sucked-in by the engine or the entire air quantity. The command variable for the admixture of the fuel is therefore picked-up intentionally at a place other than customary and apparent.

As to the rest, the process of the present invention is predicated on the physical effect that the pressure difference which is necessary in order to let a predetermined gas quantity flow per unit time either in a turbulent or laminar flow through a line increases with increasing gas temperature. By the reverse, with a predetermined pressure difference, the rate of mass flow of the gas decreases per time unit with an increasing gas temperature. The throttling of the split-gas flow serves this purpose.

The special localization of the pick-up place for the command or control variable for the fuel admixture, on the one hand, and the throttling of the hot split gas flow, on the other, must be considered together: Already the aforementioned process starts from the fact that the two quantity flows to be mixed, namely, the split gas flow leaving the gas generator and the partial air quantity flow necessary for the residual combustion of the split gases in the engine are mixed with one another at an approximately constant quantity ratio. Consequently, the flow resistances in the lines and the flow cross sections are so designed beforehand into the system that—apart from temporary disturbances—the respectively desired quantities will establish themselves in the individual line connections. This prerequisite is, of course, applicable also for the present invention. The quantities which flow in the process of the present invention within the individual line connections are therefore—apart from disturbances—at a predetermined constant ratio to one another.

If, for example, an increase of the output temperature at the split gas reactor is now caused by a disturbance in the fuel admixture, then this will lead to a slowing down of the flow by reason of the throttling at the reactor output and by reason of the volume increase of the quantity flow conditioned on temperature. This flow retardation for continuity reasons has a feedback effect on the inlet side of the reactor, i.e., on the first partial air quantity flow which also decreases. If now however, as customary, fuel were to be admixed in dependence on the magnitude of the first partial air quantity flow, then with a temperature increase at the reactor output conditioned on a disturbance, also less fuel would be supplied by reason of the flow deceleration and therewith an effect compensating the disturbance would not exactly take place; the air ratio number would not be temporarily changed in the sense of an elimination of this disturbance.

According to the present invention, the first partial air quantity flow, to which fuel is to be admixed, as such, in a predetermined quantity ratio, is therefore intentionally not used for the control of the admixture of the fuel, but instead another suitable quantity flow present in the system is picked out for that purpose which does not partake in the mentioned change quantity conditioned on disturbance or—if at all—partakes in this change quantity in the reverse sense and to a very slight extent. As a result thereof, a fuel quantity which—viewed absolutely—remains at least approximately constant is admixed to the first partial air quantity flow over a disturbance period of time whereas, in contrast thereto, the first partial air quantity flow changes conditioned by the disturbance. A displacement of the air-fuel ratio and more particularly precisely in the compensatory direction results therefrom. This means, with temperature increases conditioned on disturbances, the air proportion is reduced and thus a lower reaction temperature is controlled and vice versa. A quantity flow suitable for the fuel admixture is the entire (overall) air quantity flow and also the second partial air quantity flow. The entire air quantity flow may be considered constant—as viewed over short time intervals—since the engine sucks in identical air quantities. The second partial air quantity flow for continuity reasons changes slightly analogously in the opposite sense to the flow fluctuations of the first partial air quantity flow. However, these fluctuations of the second partial air quantity flow are smaller by the factor of the magnitude ratio of the second to the first partial air quantity flow than those of the first partial air quantity flow. This—constant—factor lies in practical systems approximately between 3 and 6 depending on the design thereof. This means, if the fluctuations of the first partial air quantity flow which are conditioned on disturbances amounts for example to about 5% thereof, then the second partial air quantity flow fluctuates in the opposite direction with respect to the first partial air quantity flow by about 1% of its own magnitude. The oppositely directed analogous fluctuation of the second partial air quantity flow, even though slight, assists the control effect, when the quantity measurement for the fuel admixture is undertaken within the same, because the admixed fuel proportion—as viewed absolutely—is changed also compensatorily—even though also slightly.

Consequently, a temperature change is converted by the throttling of the split gas flow according to the present invention at a hot place into an oppositely directed analogous compensatorily effective change of the air quantity of the associated air quantity flow. The fuel admixture takes place independently of the temperature disturbances as a result of the further measure according to the present ivention to let the quantity-dependent fuel admixture be influenced from another place; as a result thereof, the compensatory influence of the first measure comes to its full significance.

In order that the control interactions do not become excessively large and therewith the danger of an over-control and a build-up due to instability of the disturbances is avoided, the quantity flow passing through the gas generator can also be throttled at a cool place, and preferably the first partial air quantity flow can also be throttled prior to the entry into the gas generator. This throttling of the quantity flow in the reactor line connection at a cooler place effects a damping of the response of the system. The present invention thereby starts from the fact that the flow resistance of the "hot" throttle, which detects the temperature changes is less large in comparison to the entire effective flow resistance of the line connection. Appropriately, the throttle effects can take place by a heat-exchanger which is necessary anyhow.

Accordingly, it is an object of the present invention to provide a split gas production for internal combustion engines which avoids by simple means the aforementioned shortcomings and drawbacks encountered in the prior art.

Another object of the present invention resides in a split gas production for internal combustion engines which eliminates the problems in connection with the storage of permanent gases of the type such as methane, carbon monoxide and hydrogen gases.

A further object of the present invention resides in a method and apparatus for producing split gases by the use of liquid hydrocarbons which are carried along in the motor vehicle for purposes of operating its Otto-engine.

Still a further object of the present invention resides in a method and apparatus of the type described above in which the mixture sucked in by the engine is relatively cooler while the heat contained in the split gases is usefully exploited for preheating the input mixture to the reactor.

Another object of the present invention resides in a method and apparatus of the type described above which avoids excessive temperatures that may lead to thermal overloads of the mechanical parts involved and possibly also to the extinction of the reaction in the reactor.

A further object of the present invention resides in a method and apparatus for producing split gases for internal combustion engines which is relatively stable and utilizes relatively simple controls.

These and other objects, features and advantages of the present invention will become more apparent from the following description when taken in connection with the accompanying drawing which shows, for purposes of illustration only, one embodiment in accordance with the present invention, and wherein.

Figure 3:
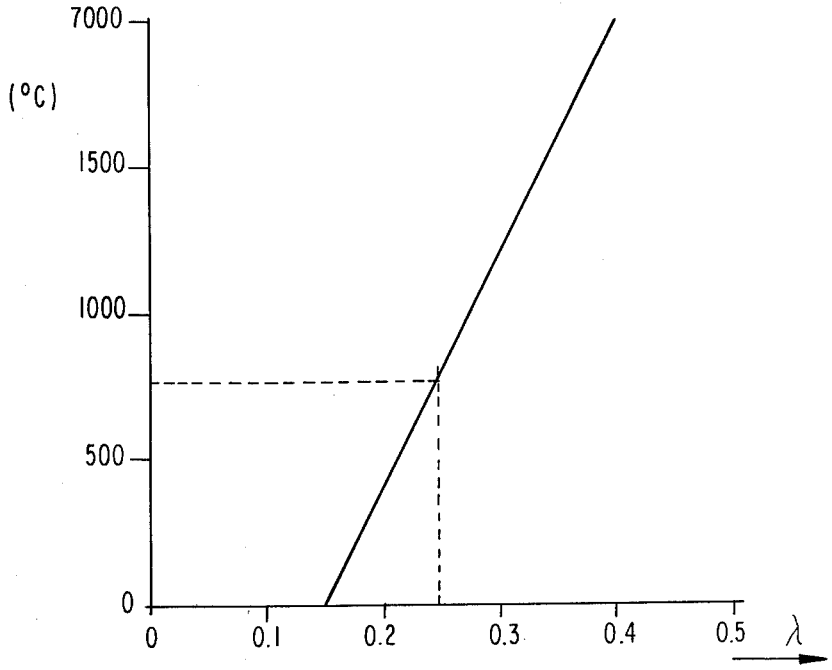
Figure 4:
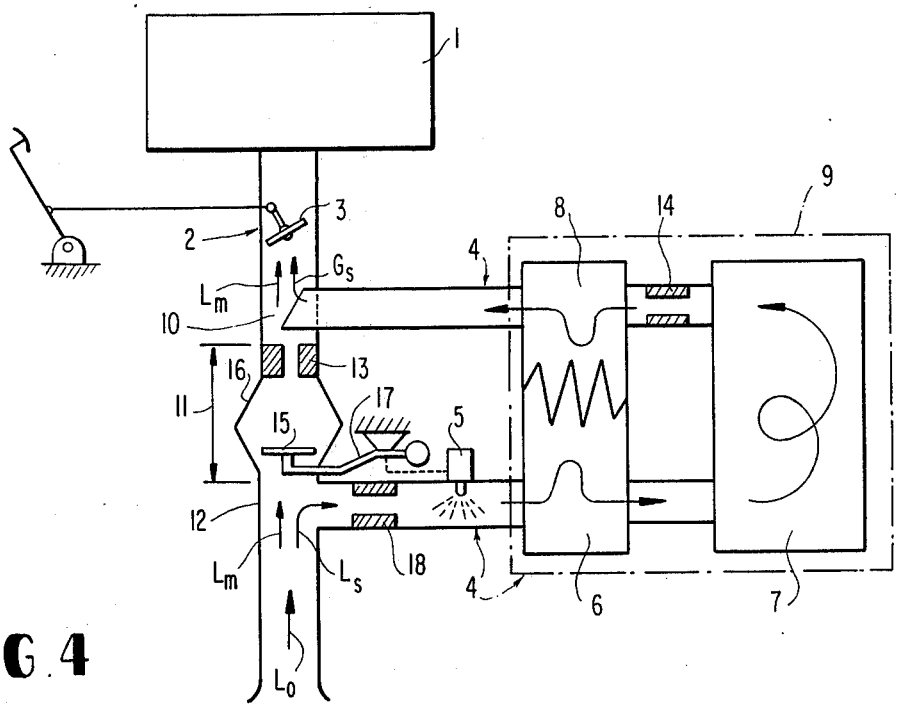

FIG. 3 is a diagram for the split gas production from methanol at temperatures above 800° C. in which the temperature change of the split gas with a recuperation operation is plotted as a function of the air ratio number λ; and FIG. 4 is a schematic view of a gas mixture production installation according to the present invention in which an air/gas mixture for a combustion engine is produced in the manner proposed by the present invention.

Figure 1:
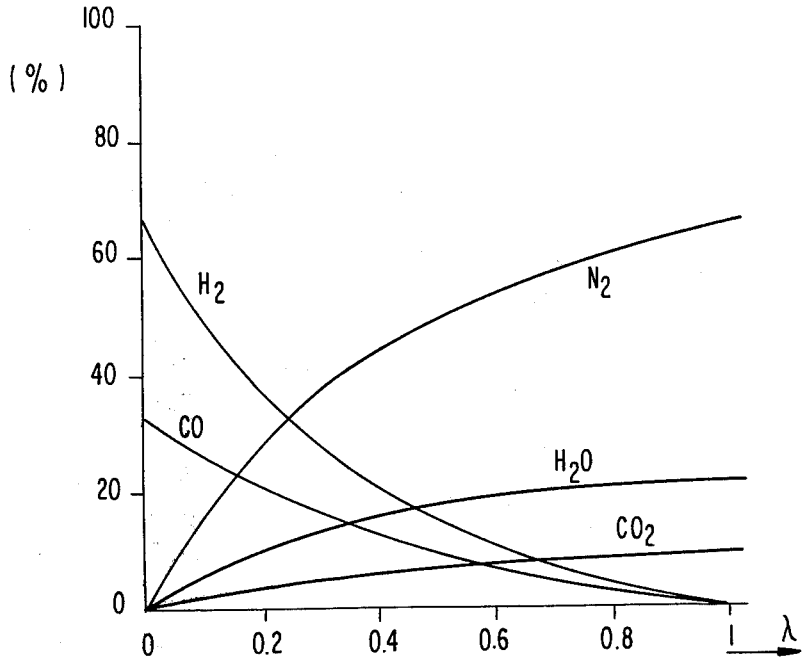
FIG. 1 is a diagram relating to the split gas production from methanol at temperatures above 800° C. in which the split gas composition is plotted as a function of the air ratio number λ.

The diagram according to FIG. 1 represents the composition of the split gas which results with the partial oxidation of methanol according to the air-splitting process at temperatures above 800° C. Methanol is thereby decomposed into $H_2$ and CO as combustible components of the split gas and into $H_2O$ and $CO_2$ as non-combustible components; furthermore, nitrogen $N_2$ is also present in the split gas. The more air which is admixed during the partial oxidation, the larger the amount of $H_2O$ and the $CO_2$ and the smaller the amount of $H_2$ and CO which result therefrom and vice versa. The formed split gas is suitable over very wide ranges of the air ratio number λ for an engine operation.

Figure 2:
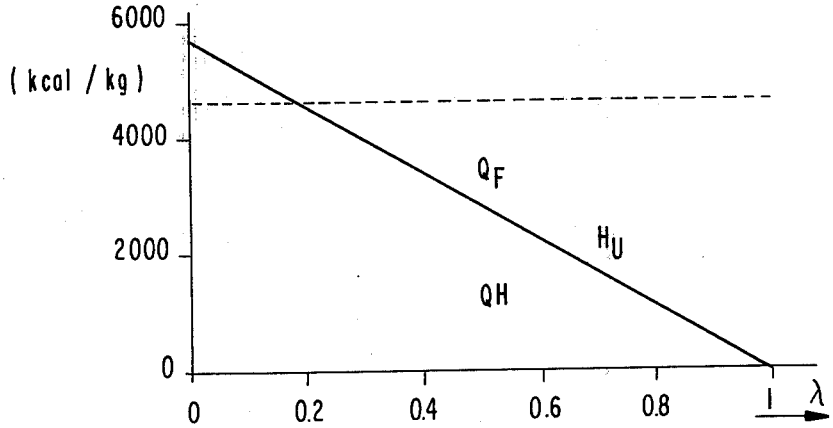
FIG. 2 is a diagram similar to FIG. 1 in which the combustion heat is plotted as a function of the air ratio number λ.

In the heat diagram according to FIG. 2 which is illustrated at the same scale for the air ratio number λ as in FIG. 1, the curve of the combustion heat contained in the split gas formed from methanol is plotted in dependence on the air admixture and the lower heating value $H_u$ of methanol is indicated in the diagram by means of a dash horizontal line. The ordinate underneath the full line of the split gas represents the heating value $Q_H$ of the split gas. The difference of this ordinate value to the heating value $H_u$ of the methanol represents the noticeable heat content $Q_F$ of the split gas. The auto-thermic point (80 = 0.18) lies at the point of intersection of the two lines. At that point, the heating value of the formed split gas is equal to the heating value of methanol. With larger air quantities, the heating value of the split gas decreases whereas, in lieu thereof, the noticeable heat content increases in relation to the air/fuel mixture fed into the reactor (exothermic oxidation); with air quantities decreasing in relation to the auto-thermic point, the heating value increases and the noticeable heat quantity decreases (endothermic oxidation).

The inter-relationship is enhanced by the feedback effect which occurs during the recuperation operation—feedback of the reactor heat to the input side thereof for the air preheating—as is shown by the steep temperature line according to FIG. 3. With an increasing air proportion, the temperature of the formed split gas increases very strongly. A change of the relative air proportion by only 5% points means a temperature change of 400° (FIG. 3). The need of a stabilization of the fuel metering system by the use of control techniques follows from this fact.

This stabilization takes place by the method according to the present invention which is to be explained by reference to the system schematically illustrated in FIG. 4. In this FIG. 4, reference numeral 1 designates a conventional combustion engine which includes a main suction linegenerally designated by reference numeral 2 in which is arranged a selectively adjustable throttle valve 3 for the load adjustment of the engine. The gas production for the engine takes place in an auxiliary line connection 4 with respect to the main suction line 2.

A fuel injection nozzle 5, the heat-emitting side 6 of a heatexchanger 6/8, a gas-splitting reactor 7 of conventional construction and the heat-absorbing side 8 of the heat-exchanger 6/8 are arranged in this auxiliary line connection 4. The reactor 7 and the heat-exchanger 6/8 together form the gas generator 9. A mixing chamber for the mixing of the formed gas with air is provided at the combining place 10 of the auxiliary line connection 4 with the main suction line 2. A throttle 13 is provided in the intermediate section 11 of the main suction line 2 between the branching place 12 of the auxiliary line connection 4 and the combining place 10, which is so dimensioned that—taking into consideration the flow resistances in the auxiliary line connection 4—the quantities flowing through the auxiliary line connection 4 and the quantities flowing through the intermediate section 11 of the main section line remain at least approximately constant at a predetermined desired ratio to one another at all rates of air flow. This throttle 13 determines the air/gas ratio for the engine (air ratio throttle).

Depending on the rotational speed of the engine 1 and the position of the throttle valve 3, the engine sucks in an overall air quantity flow $L_o$ through the suction line 2. This overall air quantity flow $L_o$ is split up at the place 12, depending on the parameters of the throttle 13, into a first partial air quantity flow $L_S$ split-gas air) and into a second partial air quantity flow $L_M$ (engine air) which are at a constant ratio to one another, for example at 1 : 5. The liquid hydrocarbons are admixed to the split-gas air $L_S$ in a quantity below the stoichiometric quantity and in finely atomized form, the mixture is preheated in the heat-exchanger 6/8 to at least approximately 800° C. and is partially oxidized into split gas in the reactor 7. The formed split gas is cooled back and the split-gas quantity flow $G_S$ is mixed with the second partial air quantity flow $L_M$.

According to the present invention, a throttle 14 is provided at the outlet of the reactor 7 for purposes of stabilizing the temperatures in the gas generator 9. This throttle 14 converts during temporary temperature changes of the split-gas conditioned on disturbances, these temperature changes into corresponding changes of the quantity flow (heat throttle). The entire pressure drop in the auxiliary line connection 4 remains nearly unchanged; the volume of the auxiliary line connection 4 increases however, for example, conditioned on temperature; consequently, the flow through the auxiliary line connection 4 slows down the temperature; consequently, the flow through the auxiliary line connection 4 slows down with temperature increases. As a result thereof, the air proportion in the auxiliary line connection 4 decreases under the assumption of an approximately constant fuel admixture—as viewed absolutely. As a result thereof, the reaction temperature again decreases. Due to the described flow deceleration in the auxiliary line connection 4, a corresponding increase of the flow quantity per unit time will result in the intermediate section 11 for continuity reasons which, however, is relatively small in relation to the second partial air quantity flow. The deficit of the auxiliary flow quantity must be compensated for by a corresponding excess in the main line connection. At least the prerequisites for a compensatory fuel admixture are particularly favorable in that connection. With temperature changes at the reactor outlet, the flow quantity in the main line connection is either not changed at all or—in the intermediate section 11—is changed only slightly and also in a compensatorily favorable manner by reason of the effect of the heat throttle 14. The present invention utilizes this fact in that the quantity measurement determinative for the fuel admixture is carried out in the main line connection 2, and more particularly in the intermediate section 11 thereof. Since the quantities in both flows—apart from temporary disturbances—are always at the same ratio to one another, this is quite possible in principle. Since, however, the main line connection flow—in contrast to the auxiliary line connection flow—does not partake in the temperature-conditioned quantity disturbances caused at the reactor output or partakes only slightly in the same and then also analogously in the same sense, a suitable signal exists in the main line connection flow for a disturbance-conditioned compensating change of the air ratio number.

A balanced float plate 15 which is supported so as to be easily movable is arranged in an air funnel 16 in a known manner. The floating position of the plate 15 or the position of the support arm 17 thereof corresponds to the through-flow quantity. Depending on the position, the injection quantity per unit time of the nozzle 5 is more or less increased or decreased.

In order that the control interactions do not become excessive and the disturbances cannot build-up due to instabilities in the system, a damping throttle 18 is arranged at a cool place in the auxiliary line connection 4 for purposes of damping the control operations. The magnitude of this throttle 18 must be determined empirically. The two throttles 14 and 18 can be integrated into the heat-exchanger in such a manner that the through-flow resistances thereof correspond exactly to the determined resistances of the respective throttles.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A method for continuously producing a charge-gas mixture for the operation of an internal combustion engine, in which liquid hydrocarbons are partially oxidized into a combustible gas mixture within a reactor under shortage of air, and in which the liquid hydrocarbons are admixed to a first partial air quantity flow which is preheated prior to entry into the reactor, at a predetermined ratio below the stoichiometric ratio, the hot gas mixture formed in the reactor is cooled off by giving off at least a considerable part of its heat to the first partial air quantity flow, is mixed with a second partial air quantity flow at an at least stoichiometrically approximately constant mixture ratio and is then fed to the internal combustion engine, comprising the steps of continuously measuring a partial air quantity flow representative of the second partial air quantity flow, metering the admixture of the liquid hydrocarbons in dependence on the measured value of said partial quantity flow, and throttling the quantity flow of the gas mixture formed by the reactor in relatively hot conditions.

2. A method according to claim 1, characterized in that the second partial air quantity flow itself is continuously measured.

3. A method according to claim 2, characterized by throttling the quantity flow passing through the reactor at a relatively cool place.

4. A method according to claim 3, characterized in that said first partial quantity flow is throttled prior to entry into the reactor.

5. A method according to claim 4, characterized in that the throttling of said first partial quantity flow and the quantity flow of the gas mixture is realized by means of the flow resistances in a heat-exchanger.

6. A method according to claim 1, characterized by throttling the quantity flow passing through the reactor at a relatively cool place.

7. A method according to claim 1, characterized in that said first partial quantity flow is throttled prior to entry into the reactor.

8. A method according to claim 1, characterized in that the throttling is realized by means of the flow resistances in a heat-exchanger.

9. An apparatus for continuously producing a charge-gas mixture for the operation of an internal combustion engine, comprising means for partially oxidizing liquid hydrocarbons within a reactor means into a combustible gas mixture under shortage of air including preheating means for preheating a first partial air quantity flow prior to entry thereof into the reactor means, means for admixing liquid hydrocarbons to said first partial air quantity flow at a predetermined ratio below the stoichiometric ratio, means for cooling off the hot gas mixture formed in the reactor means by giving off at least a considerable portion of its heat to the first partial air quantity flow, means for mixing the thus-cooled partial air quantity flow at an at least stoichiometrically approximately constant mixture ratio with a second partial air quantity flow, and means for feeding the thus obtained mixture to the internal combustion engine, characterized by measuring means continuously measuring as regards quantity, the second partial air quantity flow, metering means connected to said measuring means for metering the supply of the liquid hydrocarbons as a function of the magnitude of the measured quantity flow, and throttle means for throttling the quantity flow of the gas-mixture formed by the reactor means in relatively hot condition.

10. An apparatus according to claim 9, characterized in that the measuring means measures the second partial air quantity flow itself.

11. An apparatus according to claim 9, characterized by a further throttle means throttling the partial air quantity flow passing through the reactor means at a relatively cool place.

12. An apparatus according to claim 11, characterized in that the further throttle means throttles the first partial air quantity flow prior to entry thereof into the reactor means.

13. An apparatus according to claim 12, characterized in that both of the throttle means are constituted by flow resistances in a heat-exchanger means.

14. An apparatus according to claim 12, characterized by a main suction air line and an auxiliary air line means branching off from said main suction line at a first branching place, said auxiliary air line means including the reactor means and discharging into the main suction line downstream of the first branching place, as viewed in the normal flow direction of the air.

15. An apparatus according to claim 14, characterized in that the measuring means is arranged in a line section of the main suction line between the first branching off place and the discharge place of the auxiliary line means.

16. An apparatus according to claim 15, characterized in that a heat-exchanger means is so connected in the auxiliary line means that the reaction gases from the reactor means flow through one part of the heat-exchanger means to give off heat to the partial air quantity flow flowing through the auxiliary line means into the reactor means.

17. An apparatus according to claim 16, characterized in that the first-mentioned throttle means is located between the reactor output and the input of the heat-exchanger means for the reaction gases.

18. An apparatus according to claim 17, characterized in that a further throttle means is arranged in the auxiliary line means upstream of the heat-exchanger means on the side leading thereof to the input of the reactor means.

19. An apparatus according to claim 18, characterized by fuel injection means controlled by said measuring means for injecting fuel into the auxiliary line means upstream of the input to the reactor means.

20. An apparatus according to claim 19, characterized in that the fuel injection means is arranged in said auxiliary line means upstream of said one side of the heat-exchanger means.

21. An apparatus according to claim 20, characterized in that the further throttle means is located in said auxiliary line means upstream of said fuel injection means.

22. An apparatus according to claim 21, characterized in that a still further throttle means is provided in said line section of the main suction line downstream of the measuring means.

23. An apparatus according to claim 22, characterized in that the measuring means measures the second partial air quantity flow itself.

24. An apparatus according to claim 23, characterized in that the said first mentioned and further throttle means are constituted by of flow resistances in a heat-exchanger means.

25. An apparatus according to claim 12, characterized by a main suction air line and an auxiliary air line means branching off from said main suction line at a first branching place, said auxiliary air line means including the reactor means and discharging into the main suction line downstream of the first branching place, as viewed in the normal flow direction of the air.

26. An apparatus according to claim 25, characterized in that the measuring means is arranged in a line section of the main suction line between the first branching off place and the discharge place of the auxiliary line means.

27. An apparatus according to claim 14, characterized in that a heat-exchanger means is so connected in the auxiliary line means that the reaction gases from the reactor means flow through one part of the heatexchanger means to give off heat to the partial air quantity flow flowing through the auxiliary line means into the reactor means.

28. An apparatus according to claim 27, characterized in that the throttle means is located between the reactor output and the input of the heat-exchanger means for the reaction gases.

29. An apparatus according to claim 27, characterized in that a further throttle means is arranged in the auxiliary line means upstream of the heat-exchanger means on the side thereof leading to the input of the reactor means.

30. An apparatus according to claim 29, characterized by fuel injection means controlled by said measuring means for injecting fuel into the auxiliary line means upstream of the input to the reactor means.

31. An apparatus according to claim 30, characterized in that the fuel injection means is arranged in said auxiliary line means upstream of said one side of the heat-exchanger means.

32. An apparatus according to claim 31, characterized in that the further throttle means is located in said auxiliary line means upstream of said fuel injection means.

33. An apparatus according to claim 11, characterized in that a still further throttle means is provided in a line section of the main suction line downstream of the measuring means.

* * * * *